US005688336A

United States Patent [19]

Millard, Jr.

[11] Patent Number: 5,688,336

[45] Date of Patent: Nov. 18, 1997

[54] METHOD FOR REMOVAL OF WATER SOLUBLE POLYMERS

[76] Inventor: James B. Millard, Jr., 509 Woodruff Ct., Frankfort, Ill. 60423

[21] Appl. No.: 666,997

[22] Filed: Jun. 21, 1996

Related U.S. Application Data

[63] Continuation of Ser. No. 758,237, Sep. 9, 1991, abandoned, which is a continuation of Ser. No. 189,618, May 3, 1988, abandoned.

[51] Int. Cl.[6] ..... C11D 3/386; B08B 1/00

[52] U.S. Cl. ..... 134/42; 510/118; 510/175; 510/177; 510/200; 510/201; 510/204; 510/206; 510/241; 510/242; 510/364; 510/415; 510/435; 134/22.17; 134/22.19; 134/38

[58] Field of Search ..... 510/118, 175, 510/177, 200, 201, 204, 206, 241–242, 364, 415, 435; 134/22.17, 22.19, 38, 42

[56] References Cited

U.S. PATENT DOCUMENTS

| | | | |
|---|---|---|---|
| 1,581,413 | 4/1926 | Yoakam | 252/157 |
| 1,584,231 | 5/1926 | Koory | 252/153 |
| 2,062,273 | 11/1936 | Reed et al. | 252/156 |
| 2,567,456 | 9/1951 | Webster | 134/3 |
| 3,553,143 | 1/1971 | Bauer | 252/156 |
| 3,980,587 | 9/1976 | Sullivan | 252/546 |
| 4,185,970 | 1/1980 | Dean | 55/89 |
| 4,367,248 | 1/1983 | Ritter, II | 427/307 |
| 4,564,426 | 1/1986 | Henning et al. | 204/44.6 |
| 4,880,471 | 11/1989 | Kaiser | 106/286.6 |
| 4,950,332 | 8/1990 | Stringfield et al. | 127/55 |

FOREIGN PATENT DOCUMENTS

| | | |
|---|---|---|
| 176018 | 4/1986 | European Pat. Off. . |

*Primary Examiner*—Douglas J. McGinty
*Assistant Examiner*—Kery A. Fries
*Attorney, Agent, or Firm*—Marshall, O'Toole, Gerstein, Murray & Borun

[57] ABSTRACT

A solvent that will remove all types of commercially available water soluble polymers by breaking the covalent bonds within the polymer molecules such that these polymers can then be removed from all surfaces and equipment completely and safely by washing away with water.

The solvent consists of (in a 2½ gallon concentrated solution) 4% of ammonium chloride, 29% of ammonium hydroxide, and 67% water.

7 Claims, No Drawings

METHOD FOR REMOVAL OF WATER SOLUBLE POLYMERS

CROSS-REFERENCE TO RELATED APPLICATIONS

This is a continuation of application Ser. No. 07/758,237 filed Sep. 9, 1991, now abandoned, which is a continuation of application Ser. No. 07/189,618 filed May 3, 1988, now abandoned.

TECHNICAL FIELD

My invention relates to the removal of commercially available water soluble polyelectrolytes ("polymers") and to the need to completely and safely eliminate said polymers from equipment and all types of surfaces.

When polymers are utilized, they are transported and serviced by a variety of instrumentality and equipment. After polymers are applied by a user, an amount of polymer substance (or residue) remains on the instrumentalities and equipment that the polymer has been in contact with. The polymer residue build-up can cause instrumentality and equipment to gum up, deteriorate, and otherwise be rendered ineffective.

In addition, polymer spills or other mishandling can cause polymers to come in contact with all types of surfaces (and will cover and may impregnate these surfaces). As a result, slippery and dangerous walking conditions can occur. It is essential then, to completely remove the polymer and polymer residue from these surfaces and affected equipment.

BACKGROUND ART

There is no known product that effectively, completely, and safely removes all types of commercially available polymers from all types of surfaces. Existing household products such as ammonia or bleach may have some effectiveness on certain polymers in that they can remove some or most of the polymer or polymer residue on certain surfaces and equipment. They can never remove polymers completely from all surfaces or equipment however. Caustic and steam may also have some effectiveness but, as with bleach and ammonia, will never achieve total effectiveness.

Chlorine and methylene chloride are more effective than the above products, but can have lethal consequences. They are therefore undesirable alternatives.

DISCLOSURE OF INVENTION

I initially set out to create a solvent that would chemically alter (i.e. break down) all the various types of commercially available polymers in order to completely and safely remove them from all surfaces and equipment. What I have created is a solvent that will remove polymers and polymer residue from all surfaces by breaking the polymer bond within the polymer molecules. Precise amounts of ammonium chloride and ammonium hydroxide when combined with water allow a polymer's cohesive bond to be broken and ultimately removed from surfaces (including impregnated surfaces) by rinsing with water.

This solvent removes all types of commercially available water soluble polyelectrolytes that have come in contact with or have impregnated any and all types of surfaces and any instrumentality or equipment. The solvent is an aqueous solution including ammonium chloride in the range of 0.1% to 4.9% and ammonium hydroxide in the range of 1.0% to 29%. Preferably, a solvent includes ammonium chloride in the range of from 0.1% to 1.0% and ammonium hydroxide from 1.0% to 10%.

| | |
|---|---|
| Ammonium Chloride ($NH_4Cl$) | .18% |
| Ammonium Hydroxide ($NH_4OH$) | 1.32% |
| Water ($H_2O$) | 98.50% |
| TOTAL | 100.%= |

In concentrated form (i.e. 2½ gallon mixture), the formula is composed as follows:

| | |
|---|---|
| Ammonium Chloride ($NH_4Cl$) | 4% |
| Ammonium Hydroxide ($NH_4OH$) | 29% |
| Water ($H_2O$) | 67% |
| TOTAL | 100% |

This can be diluted 1:10, 1:20, 1:30 or 1:40 to give various forms of product strength.

The solvent can be produced on one of two ways:

First—Using a 2½ gallon (320 oz.) mixture in achieving a 100% solution, 12.8 oz. (or 4%) of ammonium chloride is dissolved into 92.8 oz. (or 29%) of ammonium hydroxide with constant mixing. After the ammonium chloride is dissolved (8 minutes of constant mixing or stirring) 214.4 oz. (67%) of water is added. The initial mixing produces an endothermic reaction. From this, further product dilutions can be made.

Second—Using the same percentages as above, 12.8 oz. of ammonium chloride can be dissolved into 214.4 oz. of water (10 minutes of constant stirring for complete dissolution). 92.8 oz. of ammonium hydroxide is then added to the above solution until it is dissolved (4 minutes of constant stirring). If the ammonium chloride is "treated", copious amounts of ammonia are given off. "Treated" ammonium chloride is a conditioned product that is widely used to prevent caking. "Untreated" ammonium chloride is much preferred over "treated" ammonium chloride then, not only for prevention of ammonia gas released, but also for the much shorter period of time for "untreated" ammonium chloride to dissolve into ammonium hydroxide (4 minutes vs. 12 minutes).

These precise proportions of ammonium chloride, ammonium hydroxide and water in combination produce the following effects:

The pH level of the solution is raised to more than 7.0. As a result, an excess of radical OH ions provide electrons which have a destabilizing effect on polymers (especially positively charged polymers or cationics).

The excess ammonium radicals in solution from the ammonium chloride and ammonium hydroxide exhibit a common ion effect with the polymers, most of which rely on ammonium radical charge sites to provide charges to the polymers themselves. With the excess of ammonium radicals, repulsion due to common ions causes the polymer chain to be elongated. When this happens, the polymer becomes more susceptible to oxidation by the chloride ions from the ammonium chloride. The free chloride ions then cause the rupture of some of the covalent bonds of the polymer, reducing the molecular weight and neutralizing some of the active charge sites. This allows the lower molecular weight products to be flushed away with water.

BEST MODE FOR CARRYING OUT THE INVENTION

Polymers are used and applied mainly in water purification, sludge dewatering and chemical manufacturing operations. Polymers and polymer residue, during and after application can be found on all types of surfaces and various instrumentality and equipment with which polymers and polymer residue comes in contact with.

The solvent should be applied (by pouring) liberally to the surface to be cleaned. The solvent should then be agitated with a stiff brush and water to break the surface and insure contact of the solvent with the polymer and/or polymer residue. The agitation should be continued until the polymer film breaks (approximately 10 minutes). Plain water should then be applied to the surface (either poured and flushed or hosed) to remove the solvent and polymer particles.

For feed equipment, hoses and piping, the solvent should be recirculated through the systems until all the polymers are free flowing and loose (approximately 20 minutes). Then apply a water rinse until polymers are dissipated and flushed away.

For belt presses and heavy equipment, spray (with an industrial sprayer) the solvent onto the surface of the belt or equipment down stream from a high pressure water rinse. Run the belt or equipment slowly and continue spraying solvent for at least three revolutions of the belt or 6 minutes on other equipment. Discontinue spraying of the solvent and allow the belt or equipment to run an extra 5 minutes while rinsing with the water rinse. Reduce the water rinse (which has been running continuously) from high pressure to low pressure at this time.

What is claimed is:

1. A method of removing a water soluble polymer or residue thereof from a surface bearing a layer of said polymer or residue, said method comprising the steps of:

(a) applying a solvent to said surface, said solvent consisting of an aqueous solution of 1.0 to 29 wt. %, inclusive, ammonium hydroxide, 0.1 to 4.9 wt. %, inclusive and the balance is water; ammonium chloride;

(b) agitating said solvent with respect to said surface for a time sufficient to break said layer to facilitate removal thereof; and (c) rinsing said surface to remove said polymer or residue.

2. The method of claim 1 wherein said ammonium hydroxide concentration is in the range of 1.0 to 10 wt. %, inclusive.

3. The method of claim 1 wherein said ammonium chloride concentration is in the range of 0.1 to 1.0 wt. %, inclusive.

4. The method of claim 1 wherein said ammonium hydroxide concentration is 29 wt. % and said ammonium chloride concentration is 4 wt. %.

5. The method of claim 1 wherein said ammonium hydroxide concentration is 1.32 wt. % and said ammonium chloride concentration is 0.18 wt. %.

6. The method of claim 1 wherein said ammonium hydroxide concentration is in the range of 1.0 to 10 wt. %, inclusive, and said ammonium chloride concentration is in the range of 0.1 to 1 wt. %, inclusive.

7. The method of claim 6 wherein the weight ratio of said ammonium hydroxide to said ammonium chloride in the range of from about 29:4 to about 1.32:0.18.

* * * * *

UNITED STATES PATENT AND TRADEMARK OFFICE

CERTIFICATE OF CORRECTION

PATENT NO. : 5,688,336
DATED : November 18, 1997
INVENTOR(S) : James B. Millard, Jr.

It is certified that error appears in the above-identified patent and that said Letters Patent is hereby corrected as shown below:

Column 4, line 4, after "inclusive" insert --,ammonium chloride--.

Column 4, line 4, after "water;" delete "ammonium chloride;".

Signed and Sealed this

Tenth Day of March, 1998

Bruce Lehman

*Attest:*

BRUCE LEHMAN

*Attesting Officer*

*Commissioner of Patents and Trademarks*